US005104049A

United States Patent [19]

McKibben et al.

[11] Patent Number: 5,104,049

[45] Date of Patent: Apr. 14, 1992

[54] SAND MULLER BOWL LINER

[75] Inventors: Kenneth D. McKibben, Defiance, Ohio; Thomas E. Wuepper, Alger, Mich.

[73] Assignee: CMI International, Inc., Southfield, Mich.

[21] Appl. No.: 579,351

[22] Filed: Sep. 4, 1990

Related U.S. Application Data

[62] Division of Ser. No. 439,171, Nov. 20, 1989, Pat. No. 5,019,196.

[51] Int. Cl.[5] ..... B02C 19/00

[52] U.S. Cl. ..... 241/300; 241/601

[58] Field of Search ..... 241/182, 183, 300, 298, 241/601, 117, 121

[56] References Cited

U.S. PATENT DOCUMENTS 2,475,814 7/1949 Bruchsaler ..... 241/300 X
4,126,922 11/1978 Eagens .
4,886,218 12/1989 Bradley et al. .

FOREIGN PATENT DOCUMENTS 2615409 11/1988 France ..... 241/300

*Primary Examiner*—Mark Rosenbaum
*Attorney, Agent, or Firm*—Harness, Dickey & Pierce

[57] ABSTRACT

A thin wall inner is positioned within the circular bowl of a sand muller to overlay the interior mulling surface upon which foundry sand is placed and is mulled by a plow blade that rotates within the bowl over its mulling surface. The bowl surface is annular and ring-like in shape. The liner is formed of a number of similar segments which are arranged together in edge to edge relationship to form an annular, ring-like cover over the bowl surface. The liner segments are secured to the bowl by bolts which extend through aligned holes in the segments and in the bowl. Most of the outer surface of the liner is spaced a short distance from the bowl surface by means of thin pads formed on the outer surface of the liner, around the area of the bolt holes. The pads contact the bowl surface, to provide a space between the remainder of the liner and the bowl surface. This space is filled with a grout-like material for bonding the liner to the bowl and for shock absorbing and load distribution. The liner is formed of a hard material which is much more wear resistant than the bowl to permit extended use of a worn bowl or to extend the life of an unworn bowl.

10 Claims, 1 Drawing Sheet

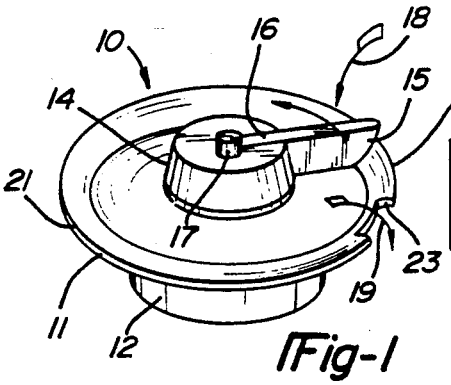
Fig-1
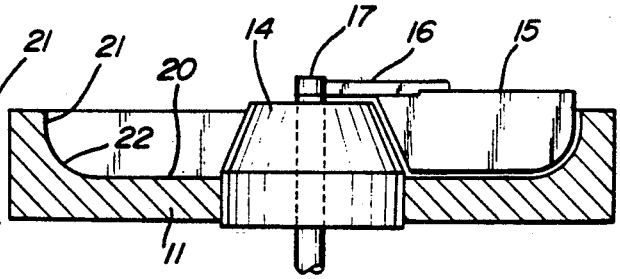
Fig-2
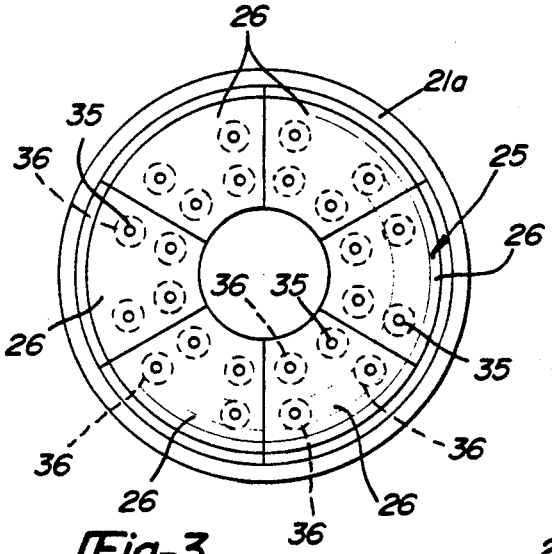
Fig-3
Fig-4
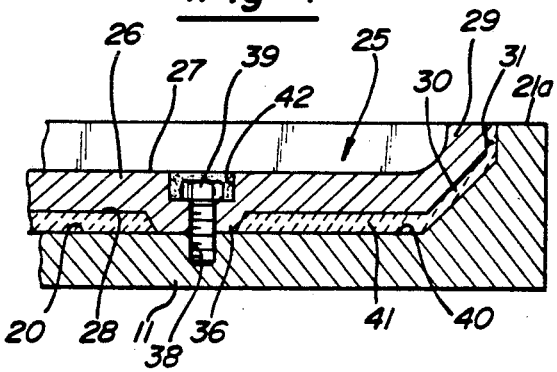
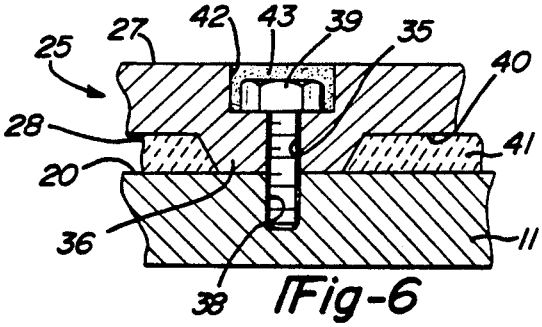
Fig-6
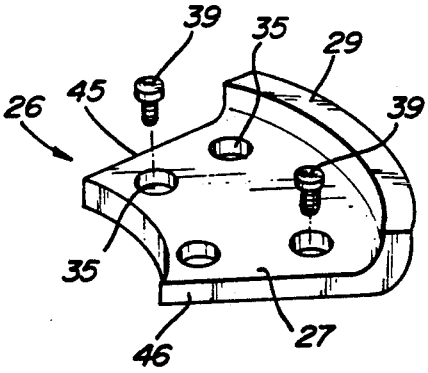
Fig-5
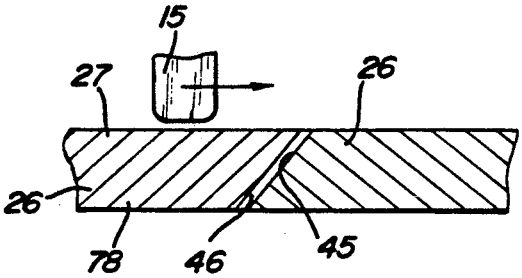
Fig-7

SAND MULLER BOWL LINER

This is a divisional of copending patent application Ser. No. 07/439,171, filed Nov. 20, 1989 now U.S. Pat. No. 5,019,196.

This invention relates to a liner for a sand muller bowl which can be used to repair worn bowls or to extend the useful life of unworn bowls.

In metal foundries which cast metal in sand molds, it is common to reuse the sand after each casting. That is, a flask type or a flask-less type mold is made with a casting cavity therein and molten metal is poured into the mold cavity for solidification. After the metal solidifies, the sand is broken away from the cast metal article and is collected for reuse in making a new mold. However, that sand is frequently in clumps or otherwise does not flow freely. Therefore, it is conventional to mull or stir the used sand to restore it to its free flowing granular state at which time it may be reused for making a new mold.

In order to stir or mull the sand, it is common to use a mulling machine which, in general, comprises a large bowl into which the sand is poured. A plow or arm is rotated within the bowl to stir and move and break up the sand in its path and ultimately, to sweep the sand particles out of the bowl into a collection device. Different types of mullers are used, but in general, they involve a bowl having an interior surface which may be relatively flat with surrounding upturned rim portions to contain the sand upon the surface. The plow, travels around the bowl, usually by means of rotating the plow from a shaft in the center of the bowl.

The movement of the plow and the sand around the interior of the bowl in a sweeping, rotating type of motion, causes abrasion and, consequently, wear of the bowl surface and the plow. Thus, the bowls must be replaced periodically.

Typically, the muller bowls in use are made of cast iron or similar cast ferrous materials which have a limited wear resistance. Ordinarily, the bowl cannot be made of a material which is too hard or too brittle because of the loading shocks due to the movement of the sand and clumps of sand upon the surface thereof and, also, because of the need to manufacture the bowl in large diameter sizes. Usually, such large size bowls are made by casting and, therefore, are made of a less abrasion resistant metal which can be easily cast.

After a relatively short period of time, as for example, a few weeks, of continuous use in a foundry, a muller bowl surface may become sufficiently worn that it must be replaced. That requires down time, expensive labor and the cost of a new bowl. Thus, there has been a need for a muller bowl which has a longer useful life than the present type bowls and, particularly, a need for some means to inexpensively repair worn bowl surfaces. This invention relates to a liner, which has a hardened, wear resistant surface, for restoring or repairing worn muller bowls or for use in new muller bowls for extending the lives of these bowls.

SUMMARY OF INVENTION

This invention contemplates a hard, thin wall, bowl-shaped, sectional liner of a size and shape to closely fit within the bowl of a sand muller for covering the sand mulling surface thereof. Such sand mulling bowls usually have a relatively flat, horizontally arranged surface upon which sand is placed for mulling. A plow, which is rotatably mounted at the center of the bowl, sweeps over the bowl surface for moving and sweeping the sand. Thus, the bowl mulling surface is annular or ring-like in configuration with a raised rim around it for containing the sand thereon. The liner closely fits over that annular, ringlike surface.

Prefereably, the liner is made of a number of substantially identical segments which are arranged edge to edge to form the complete annular, ring-like shape. The adjacent edges of the segments are sloped or angled in the direction of rotation of the plow blade to reduce wear and provide a continuous surface over which the blade may travel.

The outer surface of the liner is spaced inwardly a short distance from the interior bowl mulling surface. This may be accomplished by providing small pad-like projections on the outer surfaces of the segments. These projections engage the bowl surface to space the liner from the bowl. The space may be filled with a soft filler material, such as a grout-like material, which bonds the liner to the bowl surface and, also, absorbs shocks and evenly distributes loads applied upon the liner. In addition, the liner may be secured to the bowl by means of bolts that fit within holes in the liner, which extend through the pads, and aligned threaded bolt receiving holes in the bowl.

As can be seen, the invention contemplates a simple, relatively easily manufactured, hard, abrasion resistant liner which may be easily positioned and assembled within a pre-existing muller bowl. Thus, one object of this invention is to line the bowl with hard, wear resistant material which will extend the life of a conventional muller bowl. For example, the liner may be made of a suitable hard, abrasion resistant steel alloy material or of a ceramic material. The liner material is characterized by being hard, and particularly resistant to abrasion by sand.

Another object of this invention is to enable a foundry to substantially extend the life of its sand mulling bowl by replacing the interior mulling surface of the bowl when the original bowl surface becomes worn or, alternatively, by covering the interior of a new bowl with a more abrasion resistant material. This substantially reduces the down-time in servicing the muller and the expense of replacing worn bowls.

Further objects and advantages of this invention will become apparent upon reading the following description, of which the attached drawings form a part.

DESCRIPTION OF DRAWINGS

FIG. 1 is a perspective view which schematically illustrates a typical foundry sand muller.

FIG. 2 is an enlarged, schematic, cross-sectional view of the bowl portion of the muller with the plow in position.

FIG. 3 is a plain view of the muller bowl, with the liner positioned therein.

FIG. 4 is an enlarged, fragmentary, cross-sectional view showing the liner positioned within the muller bowl.

FIG. 5 is a perspective view of a liner segment.

FIG. 6 is an enlarged, fragmentary view showing a portion of the liner segment bolted to the portion of the bowl which it overlaps.

FIG. 7 is an enlarged, fragmentary view, showing the adjacent edges of a pair of liner segments with the plow shown schematically above them.

DETAILED DESCRIPTION

As schematically illustrated in FIG. 1, a foundry sand muller 10, which is schematically illustrated, essentially comprises a large bowl 11 upon a suitable support 12. The bowl surrounds a central hub 14. A rotating plow 15 sweeps around the hub and over the interior surface of the bowl.

The plough may be connected to an arm 16 which, in turn, is carried by a rotating shaft 17 which is driven by a suitable motor (not shown).

Typically, the muller bowl is made of a cast ferrous metal, such as cast iron or steel. It may be of considerable diameter, such as on the order of up to six to eight feet. However, this size may vary considerably as may the shape of the bowl itself.

Foundry sand, from broken sand casting molds, is poured into the bowl as illustrated schematically by the arrow 18. The sand is swept around the bowl by the plough 15. Thus, clumps of sand are broken and the sand is homogeneously stirred by the plough until the sand is discharged from the bowl through a suitable opening, as indicated by the arrow 19.

The details of a typical muller may vary from one model to another. However, in general, mullers typically include a plough blade of one form or another which sweeps the sand around the bowl upon a muller bowl interior surface. The muller bowl interior mulling surface 20 is annular or ring-like or donut-like in shape. In larger muller bowls, the mulling surface is substantially flat. In some equipment, the surface may be curved in cross-section. For illustration purposes, a flat surface 20 is shown in FIG. 2.

The bowl floor or mulling surface is surrounded by a rim 21 which has an interior rounded rim surface 22 that is continuous with the bowl floor. In addition, there may be one or more openings 23 in the rim through which the sand may be discharged from the bowl.

In normal mulling use, the sand is swept by the plough across the bowl mulling surface. The sand abrades the surface and this abrasion rapidly wears the surface. Thus, the muller bowl must be frequently replaced after continuous use in a busy foundry.

This invention contemplates providing a hard liner 25 within the bowl (see FIG. 3) for extending the life of the bowl. The liner is formed in a number of substantially identical segments 26. Each of these segments form a portion of an annular, ring-like bowl formation which is sized and shaped to fit within the muller bowl.

The liner segments provide a liner inner surface 27 which substitutes for, or replaces, the muller bowl surface 20. In addition, the liner has an outer surface 28 which is arranged above, and is slightly space from, the bowl surface 20.

The liner is provided with a rim 29 which is shaped to closely fit within the interior rim surface of the bowl. In order to facilitate the positioning of the liner within the bowl and to snugly keep the parts together, the interior of the bowl rim may be machined to form a modified rim 21*a* (see FIG. 4) which has a lower sloped wall portion 30 and an upper, cyclindrically shaped edge portion 31. The exterior surface of the liner rim 29 is correspondingly formed for closely fitting within the modified bowl rim. Alternatively, the liner may be shaped to fit within the unmodified rim surface 22, which is illustrated in FIG. 2.

Each of the liner segments 26 is arranged edge to edge with its adjacent segment to form the complete liner. The liner segments are provided with bolt holes 35 which extend through depending pads 36 that are formed on the outer surfaces of the segments. The pads may be integral with, or separately made and applied upon the segments so that they engage against the muller bowl surface 20 portions which they overlap.

The bolt holes 35 in the segments are aligned with threaded bolt holes 38 formed in the bowl. Thus, bolts 39 pass through the bolt holes in the segments and are threaded into the bolt holes in the bowl for fastening the segments to the bowl.

When the bolts are fastened in place, a space 40 is provided between the major portions of the liner outer surface 28 and the bowl surface 20 due to the pads 36. This space is filled with a filler 41, such as a grout-like material, to provide a relatively thin, continuous layer. This layer bonds the liner to the bowl and serves as a shock absorbing material which absorbs and redistributes shock loads which may be caused by the mulling action of the sand and plough. The particular material out of which the grout-like layer may be formed may vary, depending upon the size and loads applied upon the liner. The material should be sufficiently inert for use in this environment and, preferably at least slightly resilient, enough for absorbing and redistributing loads that may be caused by the mulling action and impacts against the liner. For some purposes, even ordinary cement or a plastic material may be sufficient for the purpose.

The head of the bolt 39 is inset within a counter-sunk bolt hole portion 42 which is filled with an abrasion resistant filler material 43. Any suitable cement-like or metallic filler material may be used for this purpose.

The number of segments which are used to form the complete liner will depend upon the size of the liner, that is, the diameter of the bowl. For example, while the drawing, FIG. 3, shows six segments, a large size bowl may require eight or more segments. The segments are much simpler and less expensive to manufacture when they are a relatively small size as compared to the overall size of the liner. The radial edges of the adjacent segments are engaged together in edge to edge contact to form a monolithic or continuous appearing upper liner surface. In order to protect the edges and to insure a continuous surface, the adjacent edges 45 and 46 of the segments are sloped, from the outer surface to the inner surface of the liner in the direction of travel of the plough blade. This is schematically illustrated in the enlarged, fragmentary view of FIG. 7.

This invention may be further developed within the scope of the following claims. Accordingly, it is desired that the foregoing description be read a being merely illustrative of an operative embodiment of this invention and not in a strictly limited sense. Having fully described at least one operative embodiment of this invention, we now claim:

1. A sand muller bowl upon which sand is supported and mulled by a plow blade rotated within the bowl and traveling over a surface with the surface having an upstanding rim portion that substantially surrounds it for containing the sand with the bowl, comprising:

a thin wall bowl shaped liner having a floor portion and a rim portion to overlay and completely cover an interior surface of the sand muller bowl and rim, with the liner having an inner surface, upon which sand may be mulled, and an outer surface with the inner and outer surfaces corresponding in size and shape to the interior surface of the sand muller bowl and rim for closely fitting the liner within the sand muller bowl and rim and forming a substitute sand mulling surface there;

spaced apart, thin pads provided on the liner outer surface for engaging the bowl interior surface and for spacing the remainder of the liner outer surface a short distance, substantially uniformly inwardly, away from the bowl interior surface; and a filler material placed between, and filling the space between, the interior surface of the bowl and rim and the liner outer surface for forming a layer for bonding the liner to the bowl and rim and for absorbing and distributing mulling loads applied to the liner.

2. A sand muller bowl as defined in claim 1, and including said liner being formed of material which is substantially harder and more resistant to the wear of mulling sand than material out of which the bowl is made, so that said liner may be positioned within a pre-existing bowl for substantially increasing the life of the bowl, particularly if the bowl had been worn by sand mulling therein prior to the use of the liner.

3. A sand muller bowl as defined in claim 2, and including said liner being shaped for lining an angular bowl mulling surface;

with the liner being formed of a number of substantially identical segments which are engaged together edge to edge to form an annular, ring-like liner of a size and shape to overlay the bowl mulling surface.

4. A sand muller bowl as defined in claim 3, and adjacent edges of the liner segments being sloped from the outer to the inner surface of the liner in the direction of movement of the muller plow over the inner surface of the liner, with the sloped adjacent pairs of segment edges being arranged in face to face contact to form a unitary liner inner surface.

5. A sand muller bowl liner as defined in claim 4, and including bolt holes formed through each of the segments for overlapping bolt receiving holes formed in the bowl for bolting the liner segments to the bowl;

and said pads being formed integral with the outer surface of the liner at, and surrounding, the bolt holes formed therein.

6. In a sand muller bowl with a rim and having a generally angular interior mulling surface upon which sand is placed and is mulled by a plow blade traveling within the bowl over such mulling surface, the improvement comprising:

a thin wall, bowl shaped liner having a floor portion and rim portion arranged with the bowl and rim and completely overlaying an interior mulling surface of the bowl and rim, with the liner having an inner surface upon which sand may be placed and mulled by the plow, and the liner having an outer surface;

the liner inner and outer surfaces being sized and shaped to correspond to the interior surface of the bowl and rim for closely fitting the liner with in the bowl and rim to provide a substitute mulling surface therein;

means spacing a major portion of the liner outer surface away from the bowl inner surface a short distance to form a space therebetween;

a filler material filling the space and forming a thin, load absorbing and bonding layer between the liner and bowl;

said liner being formed of a material which has a greater wear resistance to sand abrasion than material out of which the bowl is made, whereby the liner may be applied within a pre-worn bowl for permitting continued use of the bowl or within an unworn bowl to extend its useful life.

7. A bowl as defined in claim 6, and said liner being formed of a number of substantially similar segments which are arranged in edge to edge relationship to form a continuous, annular covering over the bowl interior mulling surface.

8. A bowl as defined in claim 7, and including bolt holes formed through each of the segments and corresponding, aligned bolt receiving holes formed in the bowl;

bolts extending through the aligned holes in the linear and bowl for mechanically fastening the liner segments to the bowl.

9. A bowl as defined in claim 8, and including said means for spacing the liner outer surface from the bowl interior surface comprising relatively small, thin pads formed on the outer surfaces of the liner segments around the area of the bolt holes and extending outwardly into engagement with adjacent, overlapped portions of the bowl interior surface.

10. A bowl as defined in claim 9, and wherein adjacent edges of each pair of segments are sloped from the outer to the inner liner surfaces in the direction of travel of the muller plow over the lower inner surface;

and with each adjacent pair of edges being in substantial surface to surface engagement to provide a continuous liner inner surface.

* * * * *